US011793278B2

(12) United States Patent
Armonda

(10) Patent No.: US 11,793,278 B2
(45) Date of Patent: Oct. 24, 2023

(54) BELT BUCKLE AND KNIFE ASSEMBLY

(71) Applicant: Angela Armonda, Elkhorn, WI (US)

(72) Inventor: Angela Armonda, Elkhorn, WI (US)

( * ) Notice: Subject to any disclaimer, the term of this patent is extended or adjusted under 35 U.S.C. 154(b) by 432 days.

(21) Appl. No.: 17/192,419

(22) Filed: Mar. 4, 2021

(65) Prior Publication Data

US 2022/0279901 A1 Sep. 8, 2022

(51) Int. Cl.
*A44B 11/00* (2006.01)
*B26B 1/02* (2006.01)

(52) U.S. Cl.
CPC ..... *A44B 11/005* (2013.01); *B26B 1/02* (2013.01)

(58) Field of Classification Search
CPC .. B62B 1/04; B62B 1/02; B62B 11/00; A44B 11/005; Y10T 24/4098; Y10T 24/1382; F41B 15/08
USPC ..... 224/232
See application file for complete search history.

(56) References Cited

U.S. PATENT DOCUMENTS 3,823,422 A 7/1974 Forgett, Jr.
4,096,979 A * 6/1978 Collins ..... B26B 1/00 30/162
4,313,230 A 2/1982 Chovanice
4,389,775 A * 6/1983 Collins ..... B26B 29/025 30/151
4,753,377 A 6/1988 Poluhowich
5,217,150 A * 6/1993 Chen ..... B26B 3/06 30/162
D405,338 S 2/1999 Balolia
6,145,994 A * 11/2000 Ng ..... B26B 11/008 206/374
9,095,202 B1 8/2015 Vanheteren
2007/0257073 A1 11/2007 Konstantin
2008/0295337 A1* 12/2008 Glesser ..... B26B 1/04 30/161

FOREIGN PATENT DOCUMENTS

WO WO2016053659 4/2016

* cited by examiner

*Primary Examiner* — Corey N Skurdal

(57) ABSTRACT

A belt buckle and knife assembly for converting a belt buckle into a self defense weapon includes a buckle that has a first portion is hingedly coupled to a second portion. The buckle is positionable in a folded position or an unfolded position. A belt is removably attachable to extend between each of the first portion and the second portion of the buckle for wearing around the user's waist. A knife is pivotally integrated into the buckle and the knife is positionable between a stored position and a deployed position. A catch is movably integrated into the second portion of the buckle and the catch retains the knife in either the stored position of the deployed position.

12 Claims, 6 Drawing Sheets

BELT BUCKLE AND KNIFE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to buckle devices and more particularly pertains to a new buckle device for converting a belt buckle into a self defense weapon. The device includes a knife that can be extended outwardly from the buckle device for self defense. Additionally, the device includes a plurality of finger holes such that the device can be employed in the convention of brass knuckles.

(2) Description of Related Art Including Information Disclosed Under 37 CFR 1.97 and 1.98

The prior art relates to buckle devices including a variety of two piece belt buckles that includes a knife blade integrated into a respective one of the two pieces. The prior art discloses a belt buckle with a storage compartment for storing survival gear. In no instance does the prior art disclose a buckle that can be converted into brass knuckles and which has a knife pivotally disposed therein.

BRIEF SUMMARY OF THE INVENTION

An embodiment of the disclosure meets the needs presented above by generally comprising a buckle that has a first portion is hingedly coupled to a second portion. The buckle is positionable in a folded position or an unfolded position. A belt is removably attachable to extend between each of the first portion and the second portion of the buckle for wearing around the user's waist. A knife is pivotally integrated into the buckle and the knife is positionable between a stored position and a deployed position. A catch is movably integrated into the second portion of the buckle and the catch retains the knife in either the stored position of the deployed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

Figure 3A:
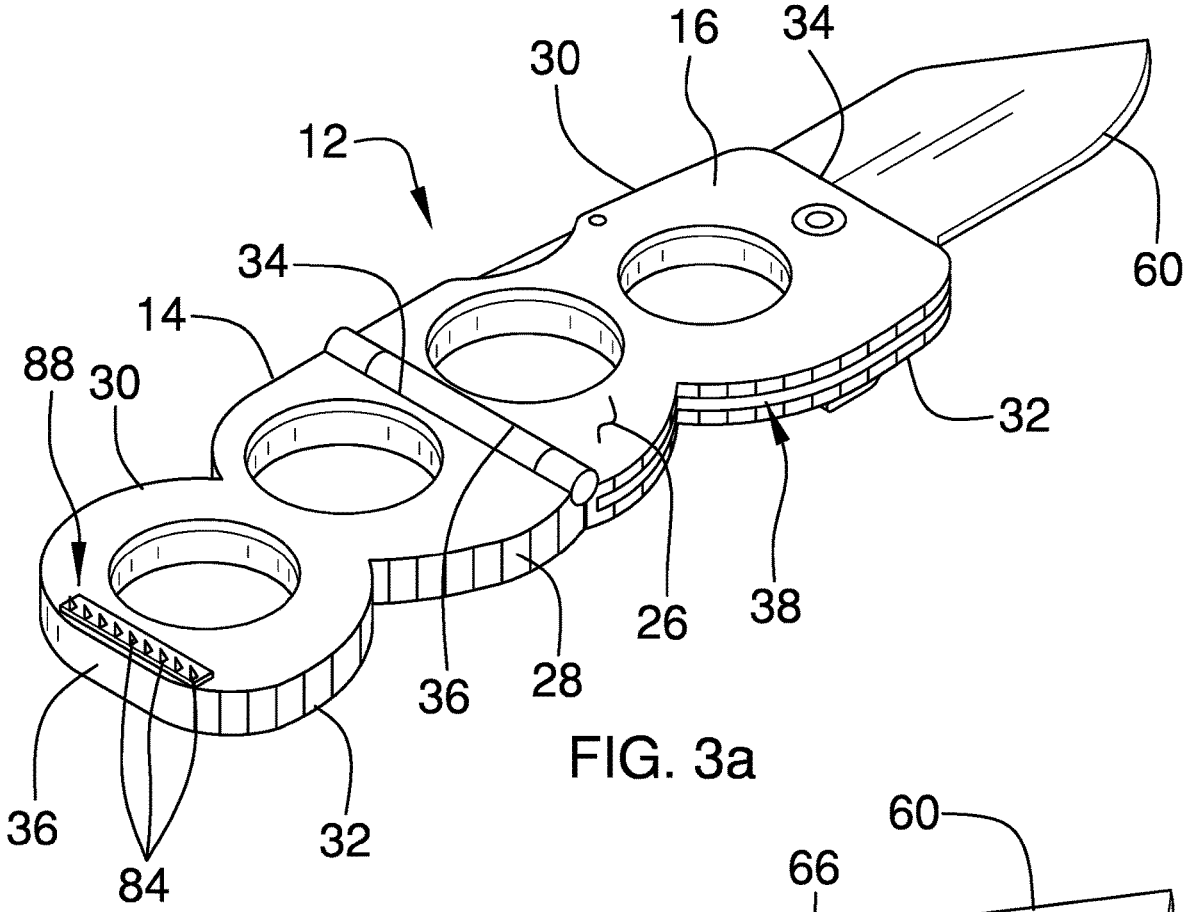

FIG. 3*a* is a back perspective view of an embodiment of the disclosure showing a plurality of spikes on a second portion of a belt buckle.

Figure 3B:
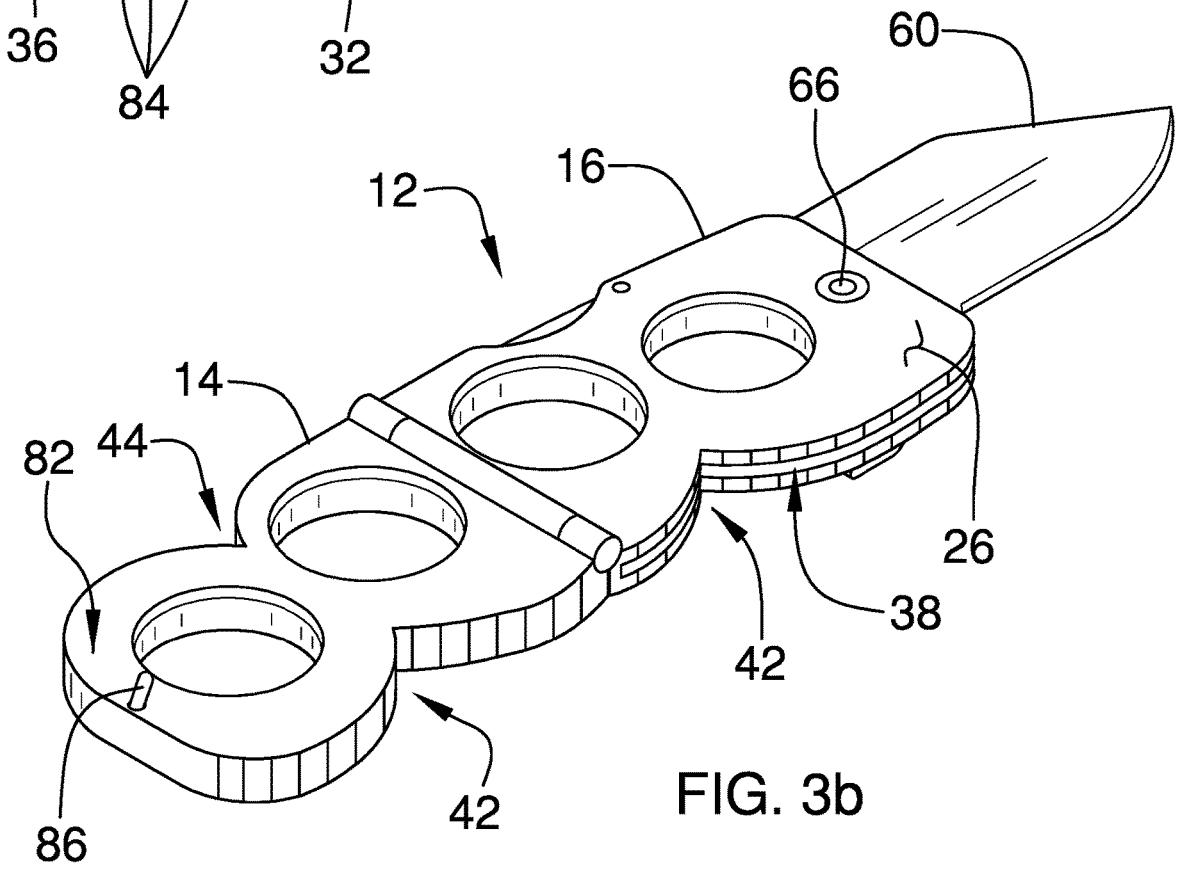

FIG. 3*b* is a back perspective view of an embodiment of the disclosure showing a post on a second portion of a belt buckle.

Figure 1:
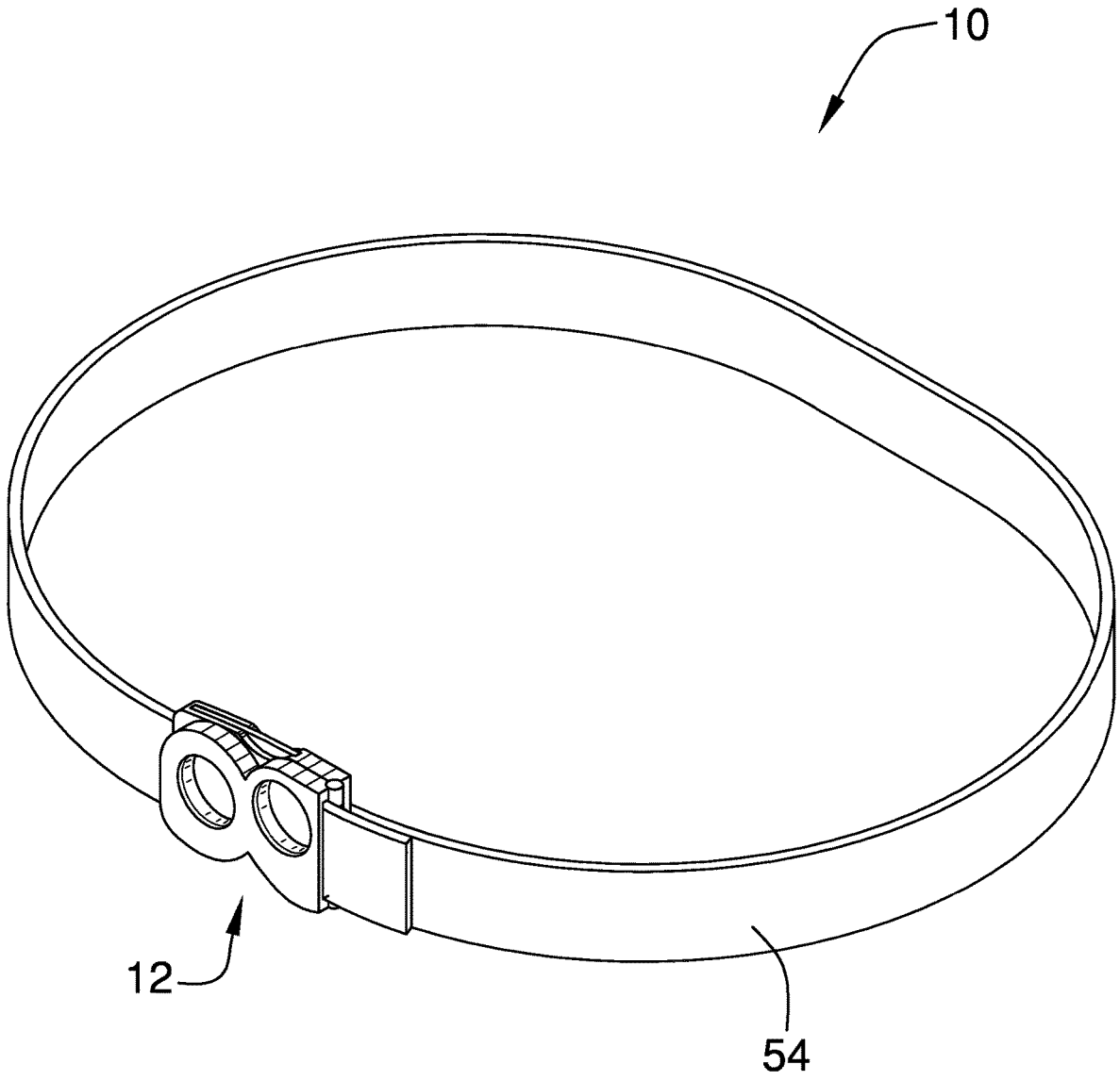
FIG. 1 is a perspective view of a belt buckle and knife assembly according to an embodiment of the disclosure.
Figure 2:
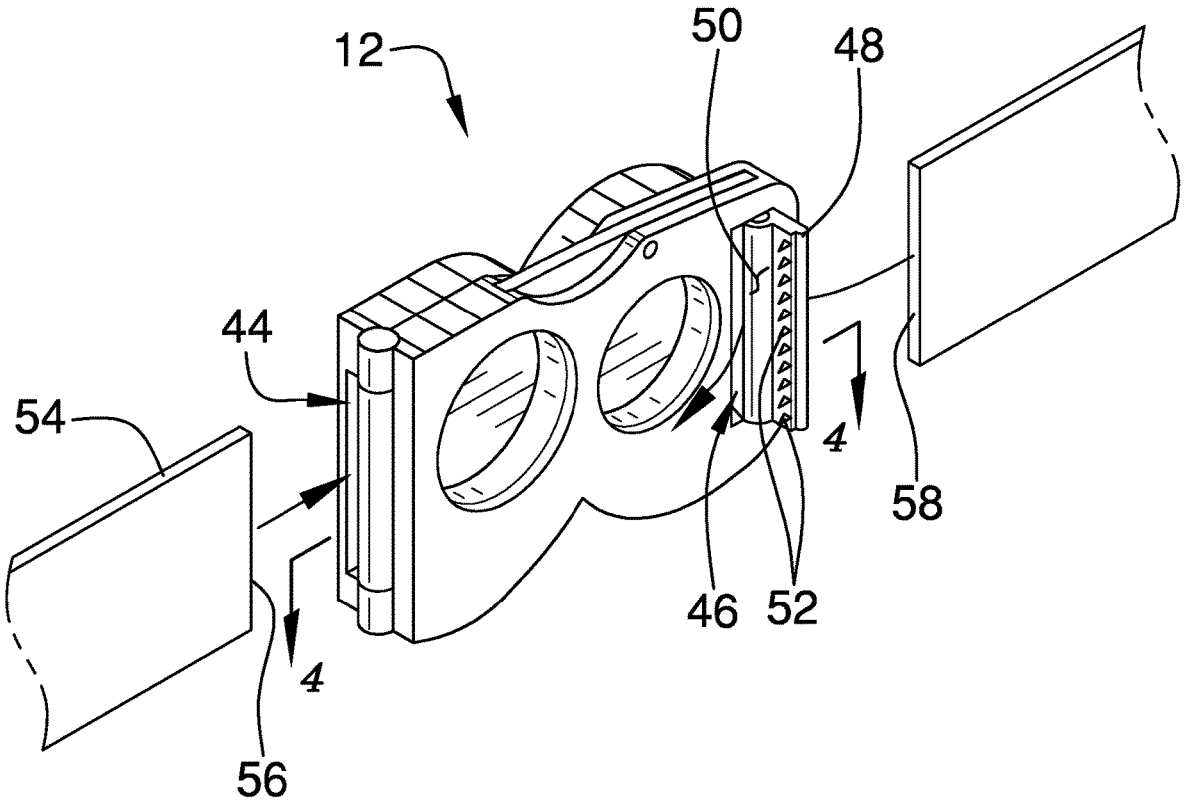
FIG. 2 is an exploded perspective view of an embodiment of the disclosure.
Figure 4:
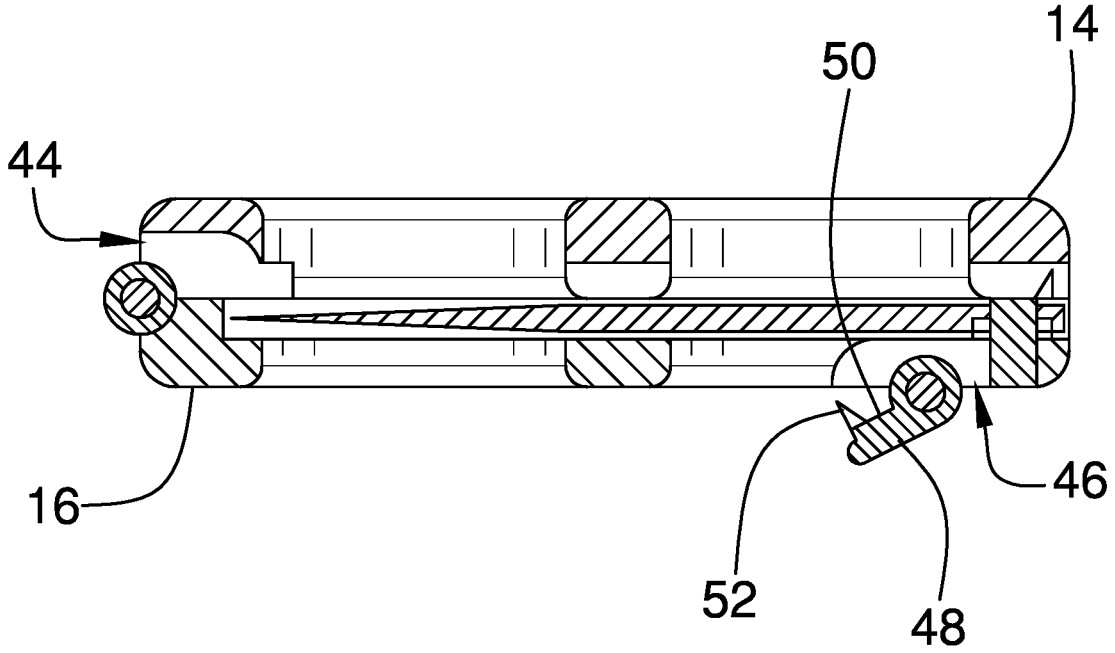

FIG. 4 is a cross sectional view taken along line 4-4 of FIG. 2 of an embodiment of the disclosure.

Figure 5:
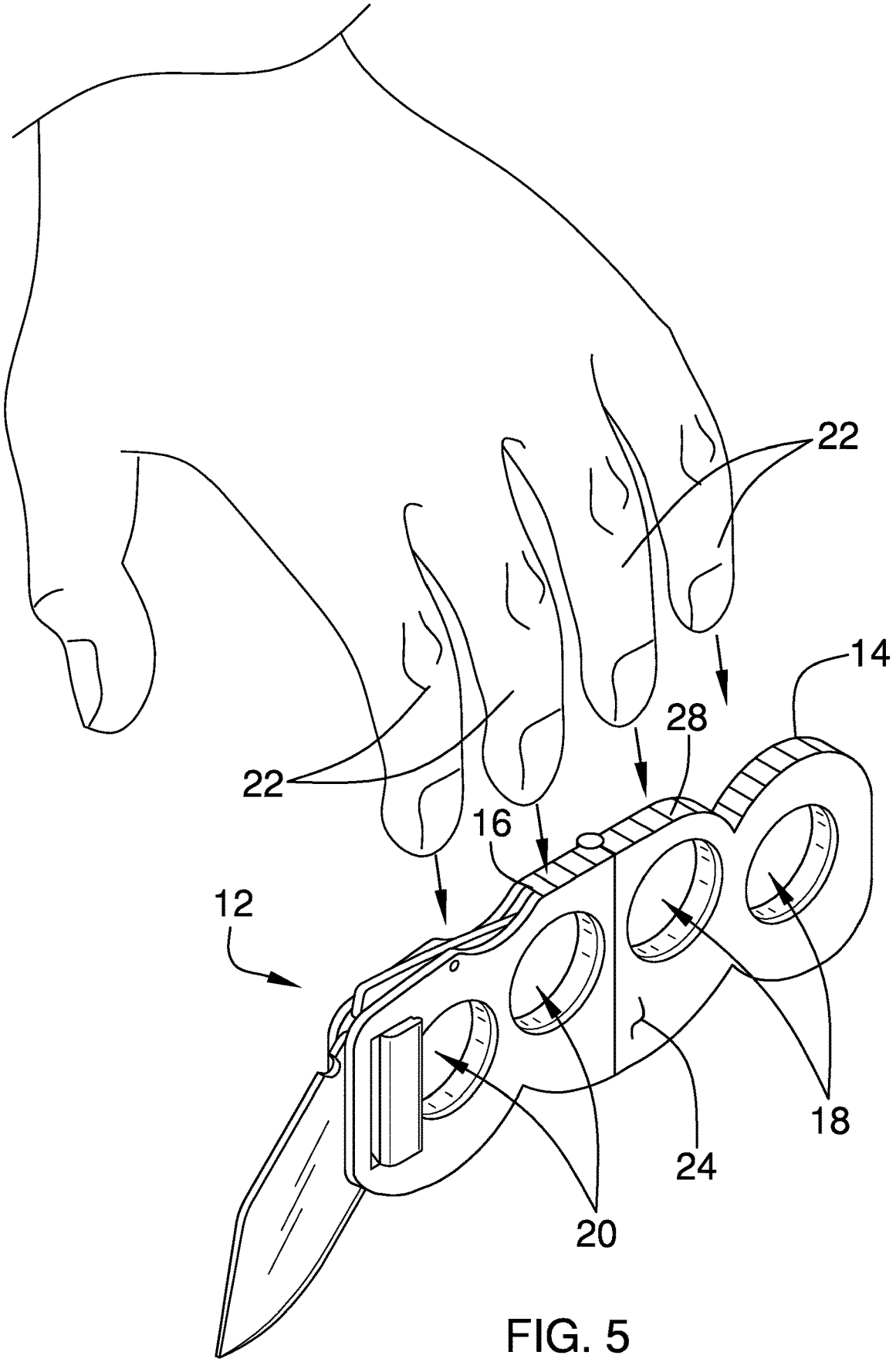

FIG. 5 is a front perspective view of an embodiment of the disclosure showing a knife being moved into a deployed position.

Figure 6:
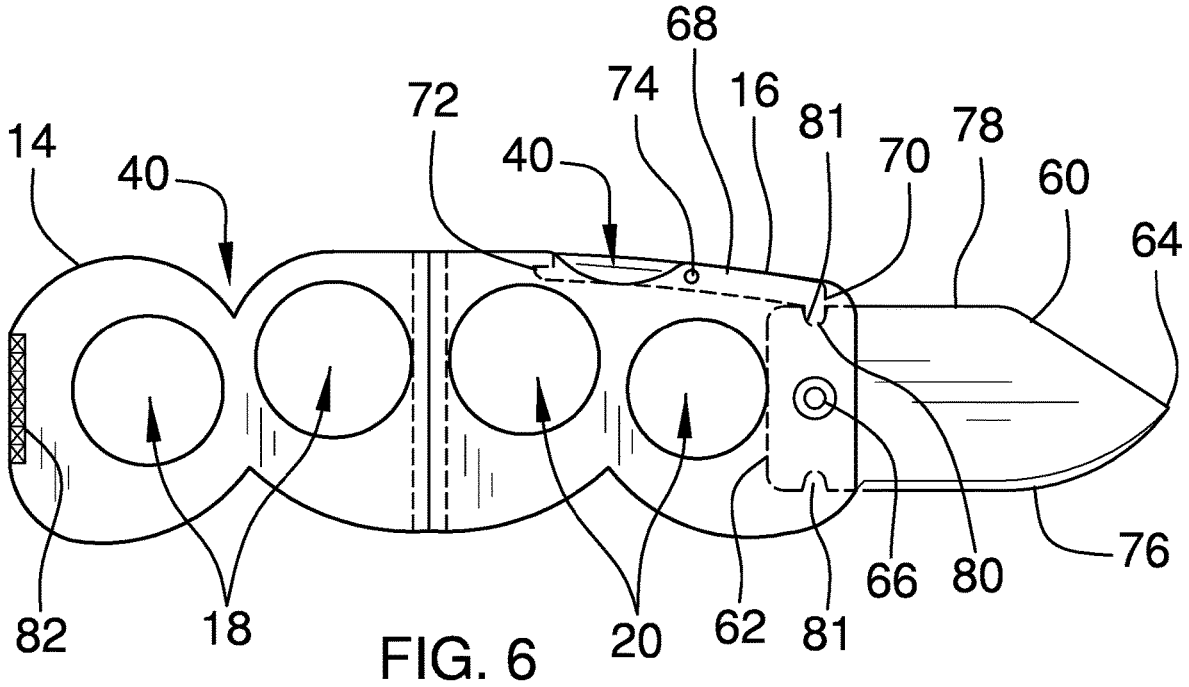

FIG. 6 is a back phantom view of an embodiment of the disclosure showing a knife in deployed position.

Figure 7:
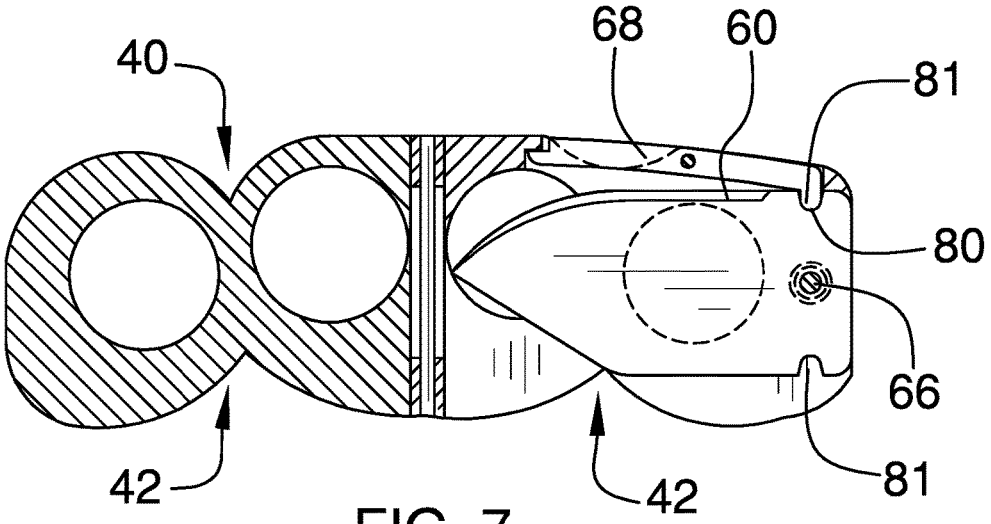

FIG. 7 is a back cutaway view of an embodiment of the disclosure showing a knife in a stored position.

DETAILED DESCRIPTION OF THE INVENTION

With reference now to the drawings, and in particular to FIGS. 1 through 7 thereof, a new buckle device embodying the principles and concepts of an embodiment of the disclosure and generally designated by the reference numeral 10 will be described.

As best illustrated in FIGS. 1 through 7, the belt buckle and knife assembly 10 generally comprises a buckle 12 which includes a first portion 14 that is hingedly coupled to a second portion 16. The buckle 12 is positionable in a folded position having the first portion 14 lying against the second portion 16. Conversely, the buckle 12 is positionable in an unfolded position having the first portion 14 and the second portion 16 lying on a plane that is coplanar. The first portion 14 has a plurality of first holes 18 each extending therethrough and the second portion 16 has a plurality of second holes 20 each extending therethrough. The first holes 18 and the second holes 20 are distributed along a common axis when the buckle 12 is positioned in the open position. In this way each of the first holes 18 and the second holes 20 can accommodate a respective one of a user's fingers 22 thereby facilitating the buckle 12 to perform as brass knuckles for self defense.

Each of the first portion 14 and the second portion 16 has a front surface 24, a back surface 26 and a perimeter edge 28 extending therebetween, and the perimeter edge 28 of each of the first portion 14 and the second portion 16 has a top side 30, a bottom side 32, a first lateral side 34 and a second lateral side 36. Each of the first holes 18 extends through the front surface 24 and the back surface 26 of the first portion 14, and each of the second holes 20 extends through the front surface 24 and the back surface 26 of the second portion 16. The first lateral side 34 of the perimeter edge 28 of the first portion 14 is hingedly coupled to the second lateral side 36 of the perimeter edge 28 of the second portion 16.

The back surface 26 of the front portion rests against the back surface 26 of the second portion 16 when the buckle 12 is in the closed position. The second portion 16 of the buckle 12 has a slot 38 extending through the top side 30 and the bottom side 32 of the perimeter edge 28 of the second portion 16. Additionally, the slot 38 extends through the first lateral side 34 of the perimeter edge 28 of the second portion 16. The top side 30 of the perimeter edge 28 of each of the first portion 14 and the second portion 16 has a first depression 40 extending toward the bottom side 32. The first depression 40 in each of the first portion 14 and the second portion 16 is centrally positioned on a respective first portion 14 and the second portion 16. The bottom side 32 of the perimeter edge 28 of each of the first portion 14 and the second portion 16 has a second depression 42 extending toward the bottom side 32. The second depression 42 is aligned with the first depression 40 in the respective first portion 14 and the second portion 16. Each of the first depression 40 and the second depression 42 may taper to a point to facilitate the first portion 14 and the second portion 16 to define brass knuckles when the buckle 12 is positioned in the open position.

The first lateral side 34 of the perimeter edge 28 of the first portion 14 has a first belt well 44 extending inwardly therein and the front surface 24 of the second portion 16 has a second belt well 46 extending inwardly therein. The second belt well 46 extends substantially between the top side 30 and the bottom side 32 of the perimeter edge 28 of the second portion 16. Additionally, the second belt well 46 is positioned adjacent to the first lateral side 34 of the perimeter edge 28 of the second portion 16. A clasp 48 is pivotally integrated into the second belt well 46, the clasp 48 has a first surface 50 and the first surface 50 has a plurality of teeth 52 each extending away therefrom. The clasp 48 is positionable in a closed position having the first surface 50 of the clasp 48 lying in the second belt well 46. Conversely, the clasp 48 is positionable in an open position having the first surface 50 of the clasp 48 being exposed with respect to the second belt well 46.

A belt 54 is removably attachable to extend between each of the first portion 14 and the second portion 16 of the buckle 12 such that the belt 54 can be worn around the user's waist. The belt 54 has a first end 56 and a second end 58, and the first end 56 is insertable into the first belt well 44. The second end 58 is extendable into the second belt well 46 when the clasp 48 is positioned in the open position having the belt 54 being looped around the clasp 48. Each of the teeth 52 on the clasp 48 engages the belt 54 when the clasp 48 is positioned in the closed position for retaining the belt 54 in the second belt well 46.

A knife 60 is provided and the knife 60 is pivotally integrated into the buckle 12. The knife 60 is positionable in a stored position having the knife 60 being concealed in the buckle 12. Conversely, the knife 60 is positionable in a deployed position having the knife 60 extending outwardly from the buckle 12. In this way the knife 60 can be employed for self defense. The knife 60 has a primary end 62 and a secondary end 64, and the primary end 62 is positioned in the slot 38 in the second portion 16 of the buckle 12. The knife 60 extends outwardly from the first lateral side 34 of the perimeter edge 28 of the second portion 16 when the knife 60 is positioned in the deployed position having the secondary end 64 of the knife 60 being exposed.

A pivot 66 extends through the front surface 24 and the back surface 26 of the second portion 16 of the buckle 12. The pivot 66 pivotally engages the knife 60 for pivotally coupling the knife 60 to the second portion 16. The pivot 66 is positioned adjacent to the first lateral side 34 of the perimeter edge 28 of the second portion 16. Moreover, the pivot 66 is biased to rotate in a first direction thereby facilitating the pivot 66 to bias the knife 60 into the deployed position. The pivot 66 may be spring loaded to bias the pivot 66 to rotate in the first direction and the pivot 66 can be urged to rotate in a second direction.

A catch 68 is movably integrated into the second portion 16 of the buckle 12 and the catch 68 can be manipulated by the user. The catch 68 is biased into an engaging position having the catch 68 engaging the knife 60 for retaining the knife 60 in the stored position. Conversely, the catch 68 is urgeable into a releasing position having the catch 68 disengaging the knife 60 thereby facilitating the knife 60 to be positioned in the deployed position. The catch 68 has a first end 70 and a second end 72, and the catch 68 is positioned in the slot 38 in the second portion 16. The catch 68 extends along the top side 30 of the perimeter edge 28 of the second portion 16. Additionally, the catch 68 has a pivot point 74 that is centrally positioned between the first end 70 and the second end 72 of the catch 68.

The first end 56 is biased downwardly in the slot 38 to engage a bottom edge 76 of the knife 60 when the knife 60 is in the stored position. Additionally, the first end 56 engages a top edge 78 of the knife 60 when the knife 60 is in the deployed position. As is most clearly shown in FIGS. 6 and 7, the catch 68 may have a lobe 80 extending downwardly from the catch 68 and the lobe 80 may be positioned adjacent to the first end 56. Each of the top edge 78 of the knife 60 and the bottom edge 76 of the knife 60 may have a slot 81 therein that receives the lobe 80 when the knife 60 is in the deployed position or the stored position. The lobe 80 may be lifted from the knife 60 when the catch 68 is urged into the releasing position thereby facilitating the knife 60 to be positioned between the stored position and the deployed position.

An engagement 82 is provided and the engagement 82 is coupled to the back surface 26 of the first portion 14. The engagement 82 is positioned adjacent to the second lateral side 36 of the perimeter edge 28 of the first portion 14. The engagement 82 releasably engages the back surface 26 of the second portion 16 when the buckle 12 is in the folded position for retaining the buckle 12 in the closed position. As is most clearly shown in FIG. 3*a*, the engagement 82 may comprise a plurality of spikes 84 that each extends away from the back surface 26 of the first portion 14 and which engage the back surface 26 of the second portion 16 when the buckle 12 is in the closed position. As is most clearly shown in FIG. 3*b*, the engagement 82 may include a post 86 extending away from the back surface 26 of the second portion 16 which may engage the back surface 26 of the second portion 16 when the buckle 12 is in the closed position.

In use, the buckle 12 is positioned in the closed position and the first end 56 of the belt 54 is inserted into the first belt well 44. The belt 54 is worn around the user's waist and the second end 58 of the belt 54 is looped around the clasp 48 for retaining the belt 54 around the user's waist. In this way the buckle 12 performs as a traditional belt buckle. The buckle 12 is removable from the belt 54 when the user feels they may be in danger of being attacked. The buckle 12 is positioned in the open position, the knife 60 is positioned in the deployed position and each of the user's fingers 22 is extended through respective ones of the first holes 18 and the second holes 20. In this way the buckle 12 can serve as a pair of brass knuckles and the knife 60 is deployed for self defense. Thus, the buckle 12 facilitates the user to quickly and discretely arm themselves to defend against a potential attacker.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A belt buckle and knife assembly for storing a knife in a belt buckle for self defense, said assembly comprising:

a buckle comprising a first portion being hingedly coupled to a second portion, said buckle being positionable in a folded position having said first portion lying against said second portion, said buckle being positionable in an unfolded position having said first portion and said second portion lying on a plane being coplanar, said first portion having a plurality of first holes each extending therethrough, said second portion having a plurality of second holes each extending therethrough, said first holes and said second holes being distributed along a common axis when said buckle is positioned in said open position wherein each of said first holes and said second holes is configured to accommodate a respective one of a user's fingers thereby facilitating said buckle to perform as brass knuckles for self defense;

a belt being removably attachable to extend between each of said first portion and said second portion of said buckle wherein said belt is configured to be worn around the user's waist;

a knife being pivotally integrated into said buckle, said knife being positionable in a stored position having said knife being concealed in said buckle, said knife being positionable in a deployed position having said knife extending outwardly from said buckle wherein said knife is configured to be employed for self defense;

a catch being movably integrated into said second portion of said buckle wherein said catch is configured to be manipulated by the user, said catch being biased into an engaging position having said catch engaging said knife for retaining said knife in either said stored position or said deployed position, said catch being urgeable into a releasing position having said catch disengaging said knife thereby facilitating said knife to be positioned in between said deployed position and said stored position.

2. The assembly according to claim 1, wherein:

each of said first portion and said second portion has a front surface, a back surface and a perimeter edge extending therebetween, said perimeter edge of each of said first portion and said second portion having a top side, a bottom side, a first lateral side and a second lateral side;

each of said first holes extending through said front surface and said back surface of said first portion, each of said second holes extending through said front surface and said back surface of said second portion; and said first lateral side of said perimeter edge of said first portion being hingedly coupled to said second lateral side of said perimeter edge of said second portion, said back surface of said front portion resting against said back surface of said second portion when said buckle is in said closed position.

3. The assembly according to claim 2, wherein said second portion of said buckle has a slot extending through said top side and said bottom side of said perimeter edge of said second portion, said slot extending through said first lateral side of said perimeter edge of said second portion.

4. The assembly according to claim 3, wherein said knife has a primary end and a secondary end, said primary end being positioned in said slot in said second portion of said buckle, knife extending outwardly from said first lateral side of said perimeter edge of said second portion when said knife is positioned in said deployed position having said secondary end of said knife being exposed.

5. The assembly according to claim 3, wherein said catch has a first end and a second end, said catch being positioned in said slot in said second portion, said catch extending along said top side of said perimeter edge of said second portion, said catch having a pivot point being centrally positioned between said first end and said second end of said catch, said first end being biased downwardly in said slot to engage a bottom edge of said knife when said knife is in said stored position, said first end engaging a top edge of said knife when said knife is in said deployed position, said first end disengaging said knife when said catch is urged into said releasing position thereby facilitating said knife to be positioned between said stored position and said deployed position.

6. The assembly according to claim 2, wherein:

said top side of said perimeter edge of each of said first portion and said second portion has a first depression extending toward said bottom side, said first depression in each of said first portion and said second portion being centrally positioned on a respective first portion and said second portion; and said bottom side of said perimeter edge of each of said first portion and said second portion has a second depression extending toward said bottom side, said second depression being aligned with said first depression in said respective first portion and said second portion, wherein said first depression and said second depression is configured to facilitate said first portion and said second portion to define brass knuckles when said buckle is positioned in said open position.

7. The assembly according to claim 2, wherein said first lateral side of said perimeter edge of said first portion has a first belt well extending inwardly therein, said front surface of said second portion having a second belt well extending inwardly therein, said second belt well extending substantially between said top side and said bottom side of said perimeter edge of said second portion, said second belt being positioned adjacent to said first lateral side of said perimeter edge of said second portion.

8. The assembly according to claim 7, further comprising a clasp being pivotally integrated into said second belt well, said clasp having a first surface, said first surface having a plurality of teeth each extending away therefrom, said clasp being positionable in a closed position having said first surface of said clasp lying in said second belt well, said clasp being positionable in an open position having said first surface of said clasp being exposed with respect to said second belt well.

9. The assembly according to claim 8, wherein said belt having a first end and a second end, said first end being insertable into said first belt well, said second end being extendable into said second belt well when said clasp is positioned in said open position having said belt being looped around said clasp, each of said teeth on said clasp engaging said belt when said clasp is positioned in said closed position for retaining said belt in said second well.

10. The assembly according to claim 2, further comprising a pivot extending through said front surface and said back surface of said second portion of said buckle, said pivot pivotally engaging said knife for pivotally coupling said knife to said second portion, said pivot being positioned adjacent to said first lateral side of said perimeter edge of said second portion, said pivot being biased to rotate in a first direction thereby facilitating said pivot to bias said knife into said deployed position.

11. The assembly according to claim 2, further comprising an engagement being coupled to said back surface of said first portion, said engagement being positioned adjacent to said second lateral side of said perimeter edge of said first portion, said engagement releasably engaging said back surface of said second portion when said buckle is in said folded position for retaining said buckle in said closed position.

12. A belt buckle and knife assembly for storing a knife in a belt buckle for self defense, said assembly comprising:

a buckle comprising a first portion being hingedly coupled to a second portion, said buckle being positionable in a folded position having said first portion lying against said second portion, said buckle being positionable in an unfolded position having said first portion and said second portion lying on a plane being coplanar, said first portion having a plurality of first holes each extending therethrough, said second portion having a plurality of second holes each extending therethrough, said first holes and said second holes being distributed along a common axis when said buckle is positioned in said open position wherein each of said first holes and said second holes is configured to accommodate a respective one of a user's fingers thereby facilitating said buckle to perform as brass knuckles for self defense, each of said first portion and said second portion having a front surface, a back surface and a perimeter edge extending therebetween, said perimeter edge of each of said first portion and said second portion having a top side, a bottom side, a first lateral side and a second lateral side, each of said first holes extending through said front surface and said back surface of said first portion, each of said second holes extending through said front surface and said back surface of said second portion, said first lateral side of said perimeter edge of said first portion being hingedly coupled to said second lateral side of said perimeter edge of said second portion, said back surface of said front portion resting against said back surface of said second portion when said buckle is in said closed position, said second portion of said buckle having a slot extending through said top side and said bottom side of said perimeter edge of said second portion, said slot extending through said first lateral side of said perimeter edge of said second portion, said top side of said perimeter edge of each of said first portion and said second portion having a first depression extending toward said bottom side, said first depression in each of said first portion and said second portion being centrally positioned on a respective first portion and said second portion, said bottom side of said perimeter edge of each of said first portion and said second portion having a second depression extending toward said bottom side, said second depression being aligned with said first depression in said respective first portion and said second portion, wherein said first depression and said second depression is configured to facilitate said first portion and said second portion to define brass knuckles when said buckle is positioned in said open position, said first lateral side of said perimeter edge of said first portion having a first belt well extending inwardly therein, said front surface of said second portion having a second belt well extending inwardly therein, said second belt well extending substantially between said top side and said bottom side of said perimeter edge of said second portion, said second belt being positioned adjacent to said first lateral side of said perimeter edge of said second portion;

a clasp being pivotally integrated into said second belt well, said clasp having a first surface, said first surface having a plurality of teeth each extending away therefrom, said clasp being positionable in a closed position having said first surface of said clasp lying in said second belt well, said clasp being positionable in an open position having said first surface of said clasp being exposed with respect to said second belt well;

a belt being removably attachable to extend between each of said first portion and said second portion of said buckle wherein said belt is configured to be worn around the user's waist, said belt having a first end and a second end, said first end being insertable into said first belt well, said second end being extendable into said second belt well when said clasp is positioned in said open position having said belt being looped around said clasp, each of said teeth on said clasp engaging said belt when said clasp is positioned in said closed position for retaining said belt in said second well;

a knife being pivotally integrated into said buckle, said knife being positionable in a stored position having said knife being concealed in said buckle, said knife being positionable in a deployed position having said knife extending outwardly from said buckle wherein said knife is configured to be employed for self defense, said knife having a primary end and a secondary end, said primary end being positioned in said slot in said second portion of said buckle, knife extending outwardly from said first lateral side of said perimeter edge of said second portion when said knife is positioned in said deployed position having said secondary end of said knife being exposed;

a pivot extending through said front surface and said back surface of said second portion of said buckle, said pivot pivotally engaging said knife for pivotally coupling said knife to said second portion, said pivot being positioned adjacent to said first lateral side of said perimeter edge of said second portion, said pivot being biased to rotate in a first direction thereby facilitating said pivot to bias said knife into said deployed position;

a catch being movably integrated into said second portion of said buckle wherein said catch is configured to be manipulated by the user, said catch being biased into an engaging position having said catch engaging said knife for retaining said knife in said stored position, said catch being urgeable into a releasing position having said catch disengaging said knife thereby facilitating said knife to be positioned in said deployed position, said catch having a first end and a second end, said catch being positioned in said slot in said second portion, said catch extending along said top side of said perimeter edge of said second portion, said catch having a pivot point being centrally positioned between said first end and said second end of said catch, said first end being biased downwardly in said slot to engage a bottom edge of said knife when said knife is in said stored position, said first end engaging a top edge of said knife when said knife is in said deployed position, said first end disengaging said knife when said catch is urged into said releasing position thereby facilitating said knife to be positioned between said stored position and said deployed position; and an engagement being coupled to said back surface of said first portion, said engagement being positioned adjacent to said second lateral side of said perimeter edge of said first portion, said engagement releasably engaging said back surface of said second portion when said buckle is in said folded position for retaining said buckle in said closed position.

* * * * *